US010570003B2

(12) United States Patent
Scott et al.

(10) Patent No.: US 10,570,003 B2
(45) Date of Patent: Feb. 25, 2020

(54) TOOL-LESS ADJUSTMENT ASSEMBLY FOR CHANGING A TORQUE SETTING ON BOTTLE CAPPING HEADSETS

(71) Applicants: Michael Patrick Scott, Midland, MI (US); Matthew Charles Lyon, Weidman, MI (US)

(72) Inventors: Michael Patrick Scott, Midland, MI (US); Matthew Charles Lyon, Weidman, MI (US)

( * ) Notice: Subject to any disclaimer, the term of this patent is extended or adjusted under 35 U.S.C. 154(b) by 221 days.

(21) Appl. No.: 15/873,371

(22) Filed: Jan. 17, 2018

(65) Prior Publication Data

US 2019/0218085 A1 Jul. 18, 2019

(51) Int. Cl.
*B67B 3/20* (2006.01)
*B65B 7/28* (2006.01)

(52) U.S. Cl.
CPC ..... *B67B 3/2093* (2013.01); *B65B 7/2835* (2013.01)

(58) Field of Classification Search
CPC ... B67B 3/2093; B67B 3/2066; B67B 3/2073; B65B 7/2835
USPC ..... 53/331.5, 317, 490
See application file for complete search history.

(56) References Cited

U.S. PATENT DOCUMENTS

| | | | | |
|---|---|---|---|---|
| 7,181,892 | B1 | 2/2007 | Henslee et al. | |
| 7,434,370 | B1 * | 10/2008 | Scott | B65B 7/2835 192/56.4 |
| 2010/0077700 | A1 * | 4/2010 | DeLuca | B67B 3/2086 53/331.5 |
| 2015/0307338 | A1 * | 10/2015 | Scott | B67B 3/2093 53/331.5 |

OTHER PUBLICATIONS

U.S. Appl. No. 14/259,419, filed Apr. 23, 2014, Ariyanayagam, et al.
U.S. Appl. No. 13/865,256, filed Apr. 18, 2013, Scott, et al.
U.S. Appl. No. 13/445,185, filed Apr. 12, 2012, Schornack.
U.S. Appl. No. 13/136,184, filed Jul. 26, 2011, Scott, et al.

* cited by examiner

*Primary Examiner* — Michelle Lopez
*Assistant Examiner* — Chinyere J Rushing-Tucker

(57) ABSTRACT

A method and means by which capping chucks can be torque adjusted without removing the capping chuck from production or taking the adjustment assembly apart for setting the torque on the equipment.

2 Claims, 7 Drawing Sheets

TOOL-LESS ADJUSTMENT ASSEMBLY FOR CHANGING A TORQUE SETTING ON BOTTLE CAPPING HEADSETS

BACKGROUND OF THE INVENTION

Capping chucks in general are removed from production or at least taken apart to make adjustment to the torque settings. This is costly because bottle capping is but one aspect of a production line of a product. This results in the loss of money and production time to adjust the torque setting.

This invention deals with a method and means by which capping chucks can be torque adjusted without removing the capping chuck from production or taking the adjustment assembly apart for setting the torque on the equipment.

This is accomplished by means of a spring loaded push button that operates vertically through the top of the adjustment assembly to release the locking mechanism for rotation of the adjustment assembly.

A horizontal spring loaded pushbutton means is known in the art as shown in U.S. patent application Ser. No. 14/259,419 filed Apr. 23, 2014. This version of a spring loaded push button assembly has certain disadvantages, in that, because of the horizontal drive, there has to be a large enough opening at the distal end of the push button, and this opening and surrounding area are susceptible to the influx of water during clean-up of the equipment which leads to corrosion and eventually seizure of the push button in the opening.

It has been discovered that a vertical spring loaded button can be used with success and overcomes this problem. A horizontal spring loaded push button concept can be found in U.S. patent application Ser. No. 14/259,410, filed Apr. 23, 2014, currently pending.

This application incorporates by reference the following patents and patent applications for what they teach with regard to bottle capping chucks.

U.S. Pat. No. 7,181,892 that issued on Feb. 27, 2007 and U.S. Pat. No. 7,434,370 that issued Oct. 14, 2008.

Patent application Ser. No. 13/865,256 entitled "Bottle Capping Chucks", filed on Apr. 18, 2013.

Patent application Ser. No. 13/445,185 entitled "Dairy Capping Headset and Chuck", filed on Apr. 12, 2012.

Patent application Ser. No. 13/136,184 entitled "Bottle Capping Chuck", filed on Jul. 26, 2011.

DETAILED DESCRIPTION OF THE INVENTION

Figure 1:
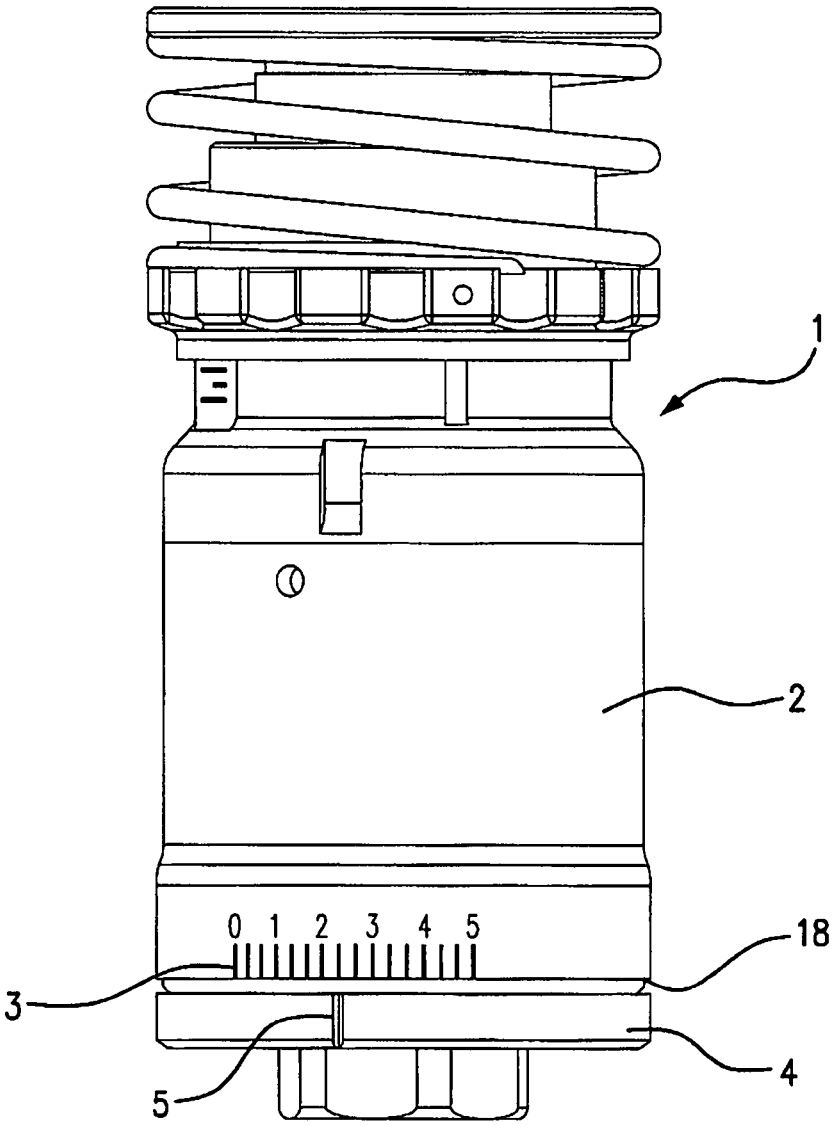
FIG. 1 is a full vertical side view of a capping chuck.

Turning now to FIG. 1, there is shown a full side view of a capping chuck 1 wherein the capping chuck is shown in a vertical position as is the usual working and operative position of the chuck 1.

There is shown the housing 2, torque scale witness marks 3 on the bottom edge 18 of the housing 2, an adjustment assembly 4, and a single indicator mark 5 showing on the adjustment assembly 4 outside surface.

Figure 2A:
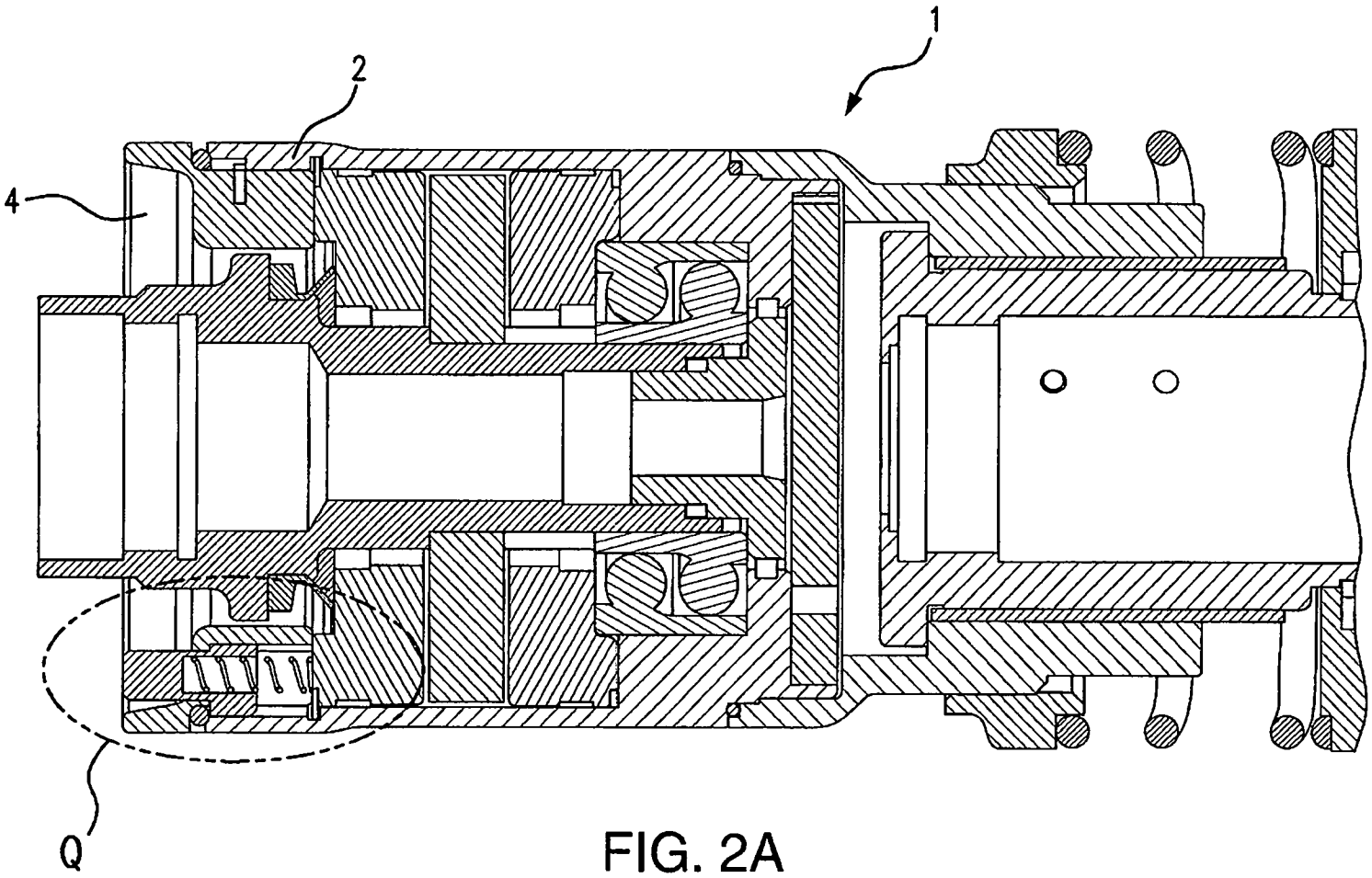
FIG. 2A is a cross-sectional view through line A-A of FIG. 1 laying horizontally showing the spring loaded push button fully extended.

Turning now to FIG. 2A, there is shown a full cross-sectional view of the capping chuck 1 of FIG. 1. There is also shown the housing 2, the adjustment assembly 4, and a portion "Q" which is the spring loaded push button assembly discussed in detail infra.

Figure 3:
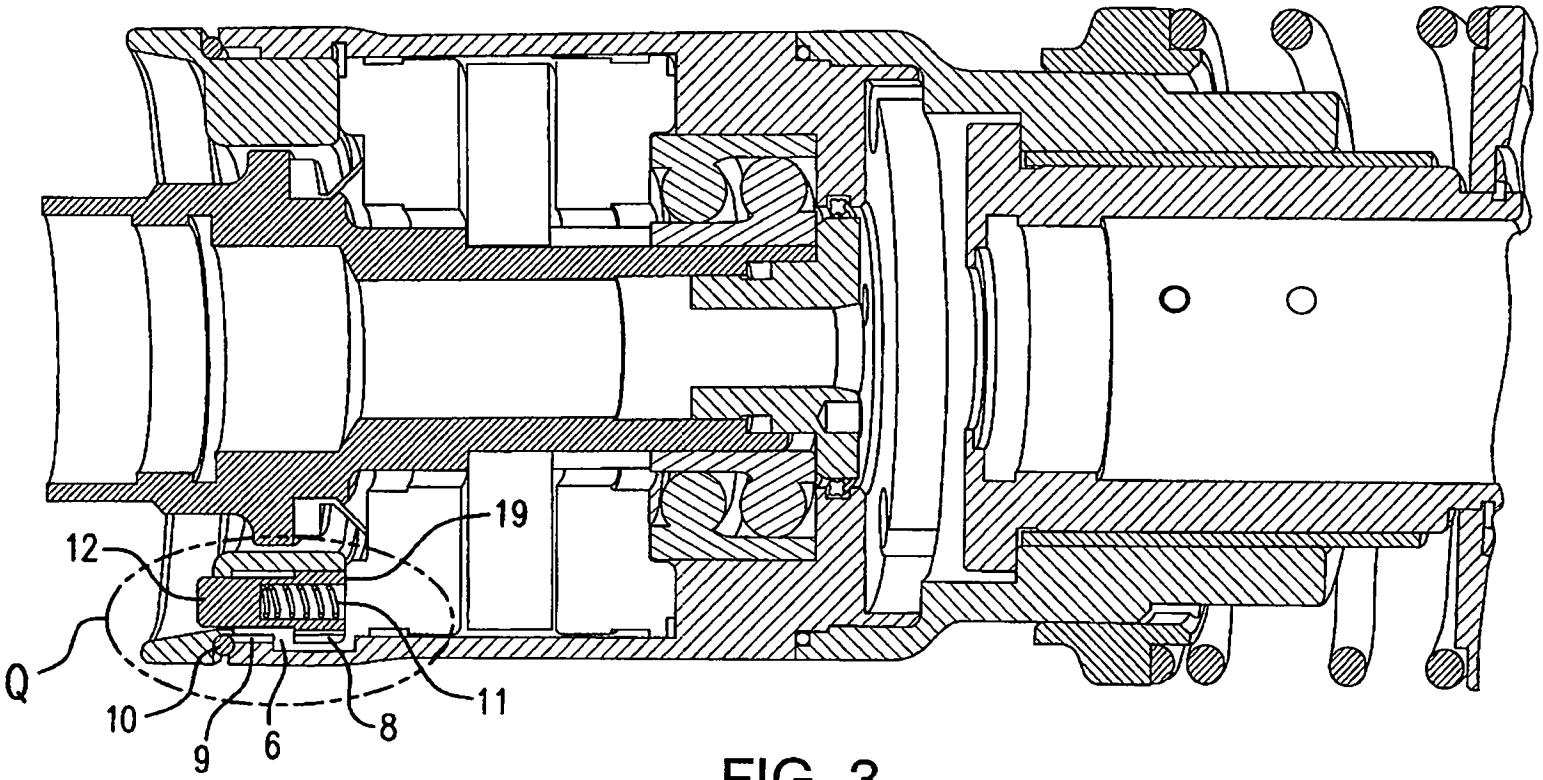
FIG. 3 is a cross-sectional view through line A-A of FIG. 1 laying horizontally showing the spring loaded push button fully depressed.

The spring loaded push button 12 as shown in FIG. 3 is in a depressed state. "Depressed state" means for purposes of this invention, that the button 12 is depressed in to the extent that the teeth 8 on the distal end 19 of the push button 12 are past the teeth 9 of the adjustment assembly 4. This operation thus releases the adjustment assembly 4 for rotation as desired. Note the gap 6 formed by moving the teeth 8 past the teeth 9. The designation 10 is a snap ring that holds the adjustment assembly 4 into the housing 2.

Figure 2B:
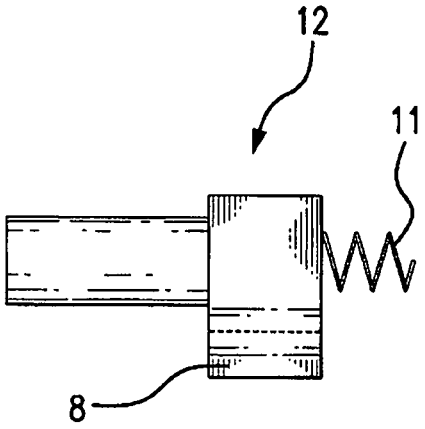
FIG. 2B is a full side view of the spring loaded push button.
Figure 2C:
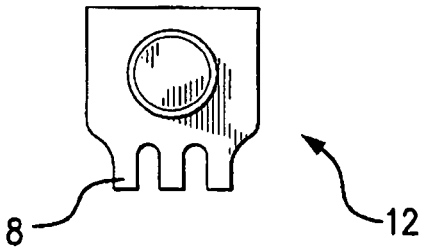
FIG. 2C is an view of the distal end of the spring loaded push button.

FIG. 2B is a full side view of the push button 12 along with spring 11. Spring 11 is also shown in FIG. 3. FIG. 2C is a full end view of the distal end of the push button 1 showing the teeth 8.

Figure 4:
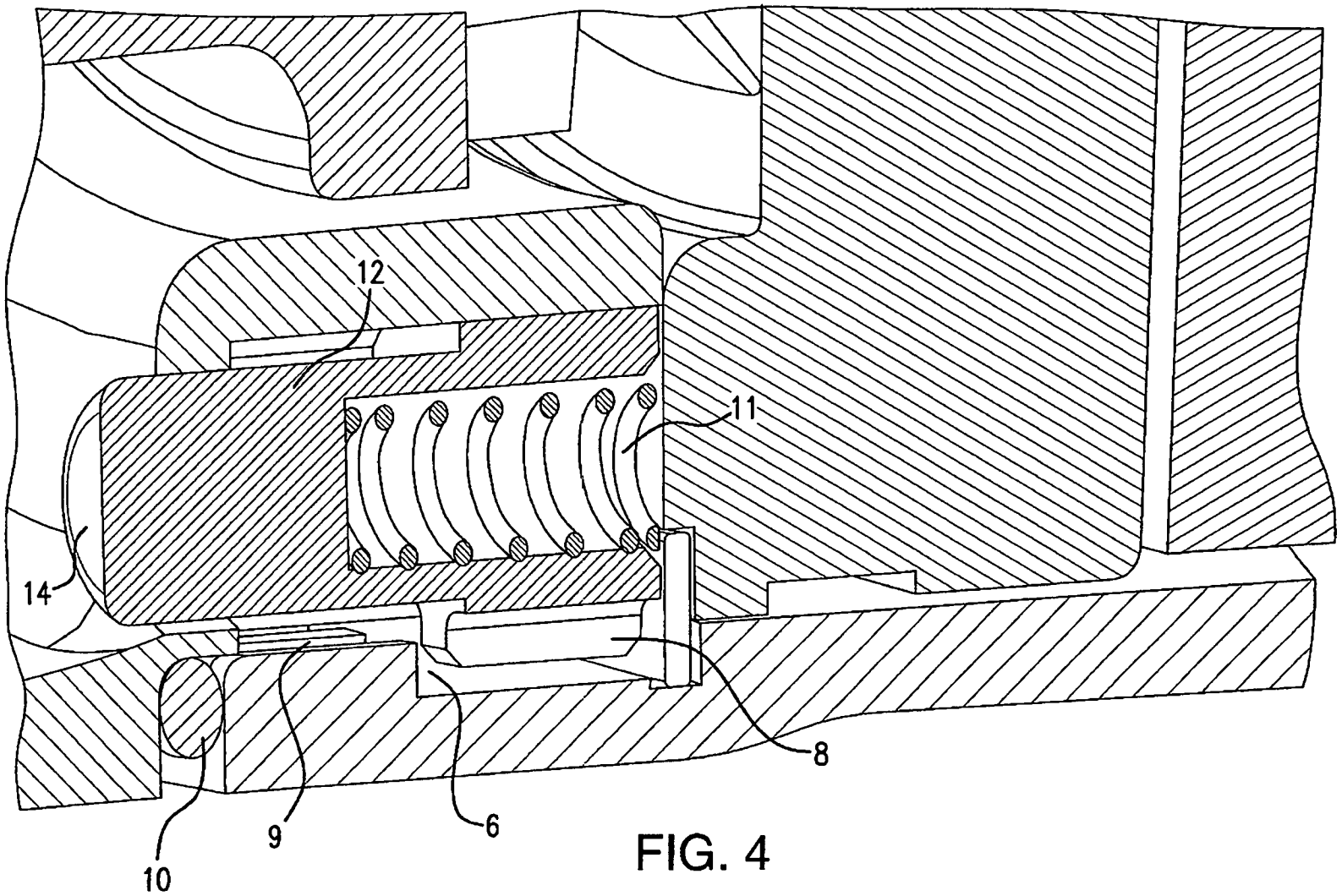
FIG. 4 is an enlarged view of the Q segment of FIG. 3.

FIG. 4 is an enlarged view of the "Q" portion showing the push button 12, the spring 11, the near end 14 of the button 12, the snap ring 10, the teeth 9 on the interior of the adjustment ring 4, the teeth 8 on the distal end of the push button 12, and, the gap at 6 which shows that the teeth 8 have been pushed past the teeth 9 for release of the adjustment assembly 4.

Figure 5:
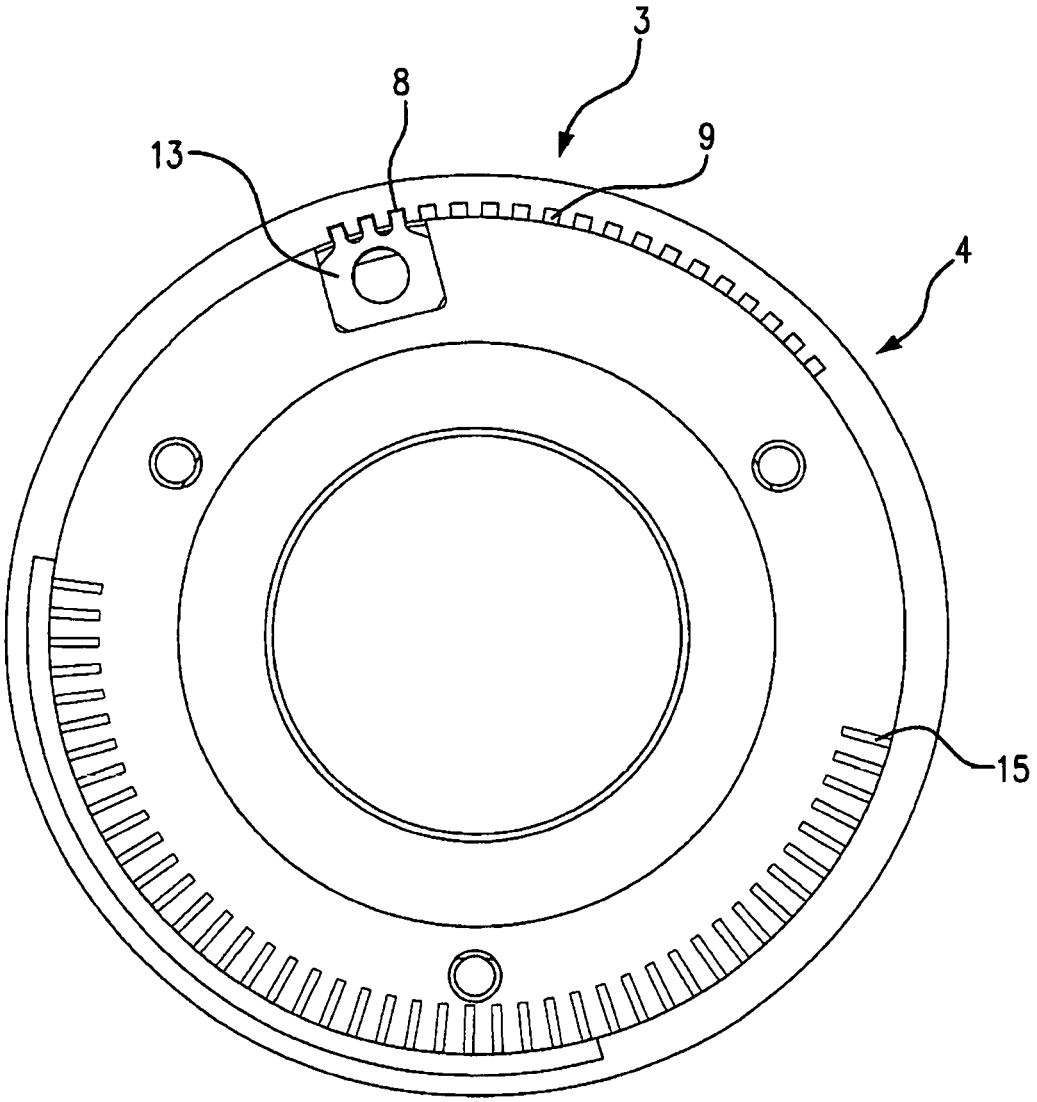
FIG. 5 is a full bottom view of the adjustment assembly without limiting pins.
Figure 6:
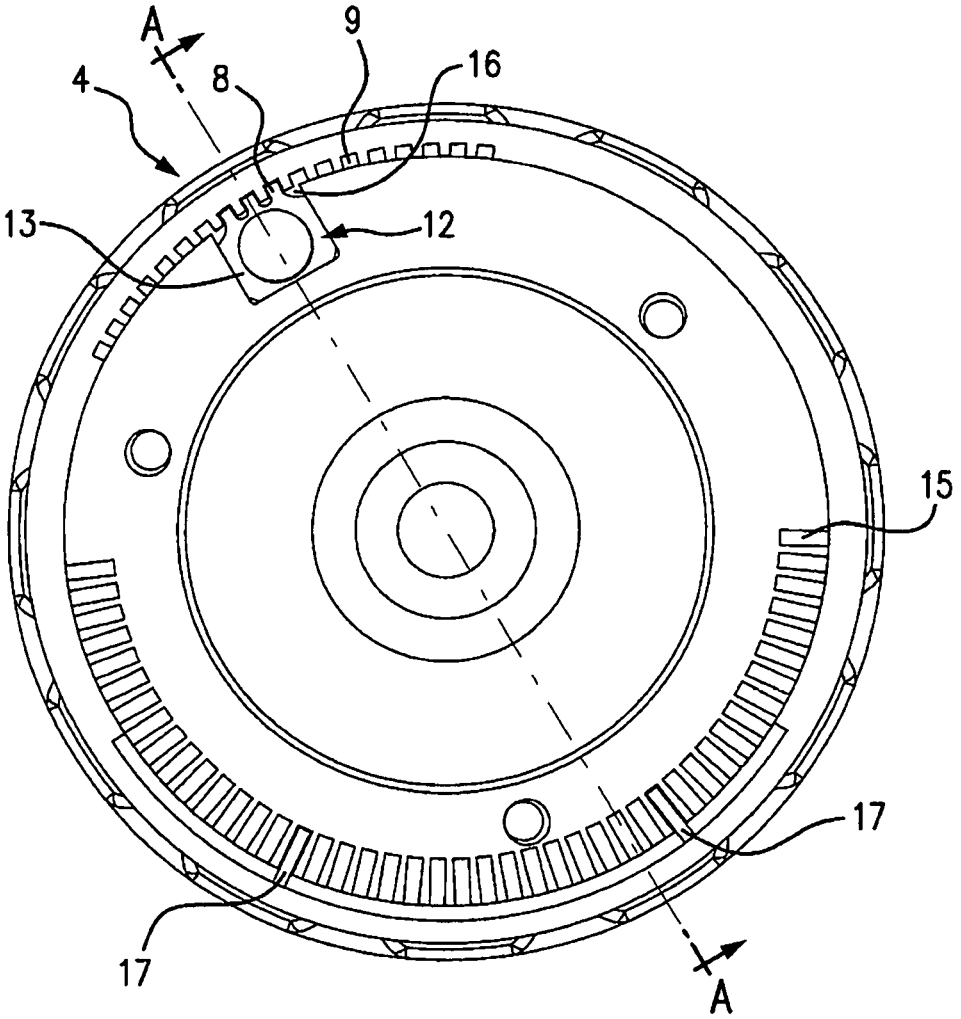
FIG. 6 is a full bottom view of the adjustment assembly with limiting pins.

Turning now to FIGS. 5 and 6, FIG. 5 is a full bottom view of the adjustment ring 4. There is shown the distal end 13 of the push button 12, showing the teeth 8 and also the teeth 9 of the adjustment assembly 4. It should be noted that this view also shows the limiting assembly 20 for the torque limiting for the capping chuck 1, in that, there is showing a plurality of openings 15 though the back side, that is, the opposite side from the torque scale witness marks 3 (not visible in FIG. 5 or 6.

FIG. 6 shows the full bottom end view of the adjustment assembly 4 wherein there is shown the distal end 13 of the push button 12, the teeth 8, the teeth 9, the opening 16 for the push button 12, the openings 15 and, the limiting pins 17. The limiting pins are inserted into the openings 15 according to the desired limits that one wishes to put on the torque setting for the capping chuck 1.

In operation, the operator wishing to change or adjust the torques on the capping chuck merely reaches into the interior of the adjustment assembly 4 and pushes the spring loaded button 12 which moves the teeth 8 past the teeth 9 of the adjustment assembly 4, and then the operator moves the adjustment assembly 4 according to the desired torque, and then, releases the button 12 to re-engage the teeth 8 and 9 and thereby lock the adjustment assembly 4 into place. If it is desired to keep the torque of the adjustment assembly 4 within certain bounds, the adjustment assembly 4 is equipped with small pins in openings 15 to provide such limits.

What is claimed is:

1. An improved tool-less adjustment assembly for changing a torque setting on a bottle capping headset, said adjustment assembly comprising:

i. a housing having a bottom edge, said bottom edge having an outside surface and an inside surface, said outside surface having marked thereon, torque scale witness marks, said bottom edge interior surface having a series of first teeth located thereon;

ii. attached to, and located at a bottom of said housing, an adjustment ring having an outside surface, said adjustment ring outside surface having a single indicator mark placed thereon;

iii. said adjustment ring having a top and a single opening through said top;

iv. located in said opening in said top, a spring button, a near end of said spring button protruding from said opening;

v. said spring button distal end comprised of second teeth that mesh with said first teeth such that when said spring button is depressed, the second teeth extend past said first teeth unlocking said adjustment assembly for rotation.

2. An improved tool-less adjustment assembly as claimed in claim 1 wherein, in addition, there is a plurality of openings through said housing opposite said torque scale witness marks for receiving stop pins.

* * * * *